US005199400A

United States Patent [19]

Sprenger et al.

[11] Patent Number: 5,199,400

[45] Date of Patent: Apr. 6, 1993

[54] METHOD AND ARRANGEMENT FOR THE IDLE CLOSED-LOOP CONTROL OF AN INTERNAL COMBUSTION ENGINE

[75] Inventors: Otto Sprenger, Kornwestheim; Klaus Heck, Hohenacker; Manfred Mezger; Stefan Huwig, both of Tamm, all of Fed. Rep. of Germany

[73] Assignee: Robert Bosch GmbH, Stuttgart, Fed. Rep. of Germany

[21] Appl. No.: 796,621

[22] Filed: Nov. 22, 1991

[30] Foreign Application Priority Data

Nov. 28, 1990 [DE] Fed. Rep. of Germany ..... 4037772

[51] Int. Cl.[5] ..... F02D 41/16

[52] U.S. Cl. ..... 123/339

[58] Field of Search ..... 123/339

[56] References Cited

U.S. PATENT DOCUMENTS 4,414,943 11/1983 Nagase ..... 123/339
4,441,471 4/1984 Kratt et al. ..... 123/339
4,465,043 8/1984 Denz et al. ..... 123/339 X
4,563,989 1/1986 Peter ..... 123/339

*Primary Examiner*—Tony M. Argenbright

*Attorney, Agent, or Firm*—Walter Ottesen

[57] ABSTRACT

A temperature-dependent base desired value for the opening angle is determined in a method for precontrolling the opening angle of a throttle flap during the idle engine-speed control of an internal combustion engine. This temperature-dependent base desired value is then modified within a start-time duration. The modification takes place in that, during start, a temperature-dependent angle increase is determined which is multiplied by a time-reduced multiplier factor and the product is additively superposed on the base desired value. With this procedure, and notwithstanding the simple method sequence, it is ensured that the start phase of a warm internal combustion engine takes place without engine-speed increases. It is especially advantageous to modify additional engine-speed base desired values in a corresponding manner. In this case, hardly any additional measures must be undertaken which go beyond those which must be undertaken to modify the base desired value for the opening angle of the throttle flap. For cold starts, an increase of the engine speed is obtained in the start phase without the danger being present that the increase takes place for warm engines.

5 Claims, 2 Drawing Sheets

METHOD AND ARRANGEMENT FOR THE IDLE CLOSED-LOOP CONTROL OF AN INTERNAL COMBUSTION ENGINE

FIELD OF THE INVENTION

The invention relates to a method and an arrangement for precontrolling the opening angle of a throttle flap during the idle closed-loop control of an internal combustion engine. During idle closed-loop control, the opening angle of the throttle flap is so controlled that the engine speed adjusts to a pregiven engine speed.

BACKGROUND OF THE INVENTION

In conventional methods, a coarse adjustment of the angle takes place with the aid of the mentioned precontrol while the fine adjustment takes place via an engine-speed closed-loop control. One such conventional method will be explained in greater detail with reference to FIG. 2.

The throttle flap (DK) 10 has an opening angle which is to be adjusted and is arranged on an internal combustion engine 11. An actuator element (not shown) is assigned to the throttle flap 10 and is driven by the output signal of an idle controller 12 in order to adjust the throttle flap angle to a desired value DK_SOLL. For this purpose, a first subtraction point 13 receives the above-mentioned desired value DK_SOLL as well as the actual value DK_IST in order to form the difference between the two values. The position controller 12 controls based on this difference, that is, based on the control deviation in the opening angle.

The desired value DK_SOLL for the throttle flap angle is made up of two components, namely, a precontrol value DK_VOR and a control value DK_REG which are combined additively in a precontrol point 14. The value DK_REG is the output signal of an engine-speed controller 15 which forms this output signal in dependence upon the control deviation between an engine-speed desired value N_SOLL and the engine-speed actual value N_IST with the control deviation being generated in a second subtraction point 16. The desired engine speed N_SOLL is read out from an engine-speed characteristic field 17 in dependence upon the engine temperature. The precontrol value DK_VOR is the second value supplied to the precontrol point 14 and is the result of a multiple modification of a basic desired value DK_SOLL for the opening angle of the throttle flap. Base desired values are read out from an opening-angle characteristic field 18 in dependence upon the engine temperature. A modification then possibly takes place in a multiplier point 19 which will be discussed further below. Thereafter, a multiplicative or additive combining with correction variables takes place in a combining point 20. The correction variables are supplied from a correction component 21. Load-dependent corrections are of concern here. For example, to maintain the desired idle engine speed, the throttle flap angle must be increased if an air conditioner is switched on.

The correction in the multiplier point 19 is essential in connection with the following. A start phase correction is of concern here having a time-reduced multiplier factor FAKSTA represented by block 8 and which is set to a maximum value such as the value two when the engine is started and then decays to the value one within several seconds. The start of the engine is indicated via the signal of an ignition lock 22. As a result of the foregoing, the temperature-dependent base desired value DK_GRUNDSOLL for the opening angle of the throttle flap is modified to increase this angle during the starting phase to ensure that the engine 11 is supplied with more air and more fuel in this time duration.

It is noted that for an actual idle control still further correction values are effective and that an adaption is especially present. Details of this kind are, however, without significance with respect to the subject matter at hand.

The known method described above with respect to FIG. 2 has the disadvantage that the start factor FAKSTA is always operative in the start phase. This leads to the condition that even during starting of an engine which is warm, a throttle value DK_SOLL occurs which is relatively high and which causes an unwanted increase in engine speed for this operating condition. This disadvantage has up until now been accepted in order to maintain, when starting a cold engine, the increase of the opening angle of the throttle flap which is required during starting.

The problem has long existed to provide a method and an arrangement for precontrolling the opening angle of a throttle flap to permit, for a simple operation, an increase of the opening angle of the throttle flap in the starting phase of a cold engine which, however, does not lead to this kind of increase for a warm engine.

SUMMARY OF THE INVENTION

The method according to the invention for precontrolling the opening angle of a throttle flap during the idle engine-speed control of an internal combustion engine includes the following steps: determining a temperature-dependent base desired value for the opening angle; determining a temperature-dependent angle increase during the start of the engine; multiplying this angle increase by a time-reduced multiplier factor; and, adding the product to the base desired value.

Accordingly, with the method of the invention, the angle increase in the starting case is not produced alone by the time-reduced multiplier factor FAKSTA; instead, it is determined by means of this factor and additionally an angle increase whose value at the start of the engine is dependent on the engine temperature present at start. For a warm engine, this angle increase is at zero or very near zero so that the temperature multiplier factor does not become operative. For a cold engine, the angular increase is in contrast relatively large so that its effect becomes significant after multiplication with the known time-reducing factor. In the operation of the method, it is only slightly more effort to determine the temperature-dependent angle increase during starting, for example, by reading out a characteristic field. However, with this slight additional effort, the above-mentioned problem is completely solved.

It is advantageous to select the multiplier factor so that this factor has the value one during start and has the value zero as a lower limit value. In this case, the temperature-dependent angle increase can be precisely that angle increase which is measured on a test stand under the condition that the same idle engine speed self adjusts in the starting phase for all start engine temperatures. The base desired values can be used directly since they no longer have to be modified after the start phase has passed (because of the end value zero of the multiplier factor) when an angle increase having a value significantly greater than zero was determined when starting with a cold engine.

It is especially advantageous to modify the desired value for the engine-speed control in correspondence to the desired value for the position control of the throttle flap. For this purpose, a temperature-dependent engine-speed increase is additionally determined at the start of the engine. This temperature-dependent increase is multiplied by the same time-reduced multiplier factor as the temperature-dependent angle increase and the product is added to an engine-speed base desired value. In this way, it is possible for a cold engine to obtain an engine-speed increase during the start phase in order to bring the engine up to temperature while with an engine which is already warm, the actual desired idle engine speed adjusts immediately at start without any increase.

The arrangement according to the invention for precontrolling the opening angle of a throttle flap during idle engine-speed control of an engine includes the following function groups: a unit for determining a temperature-dependent base desired value for the opening angle; a unit for determining a temperature-dependent angle increase at the start of the engine; a multiplier unit for multiplying the angle increase by a time-reduced multiplier factor; and, an adding unit for adding the product to the base desired value.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
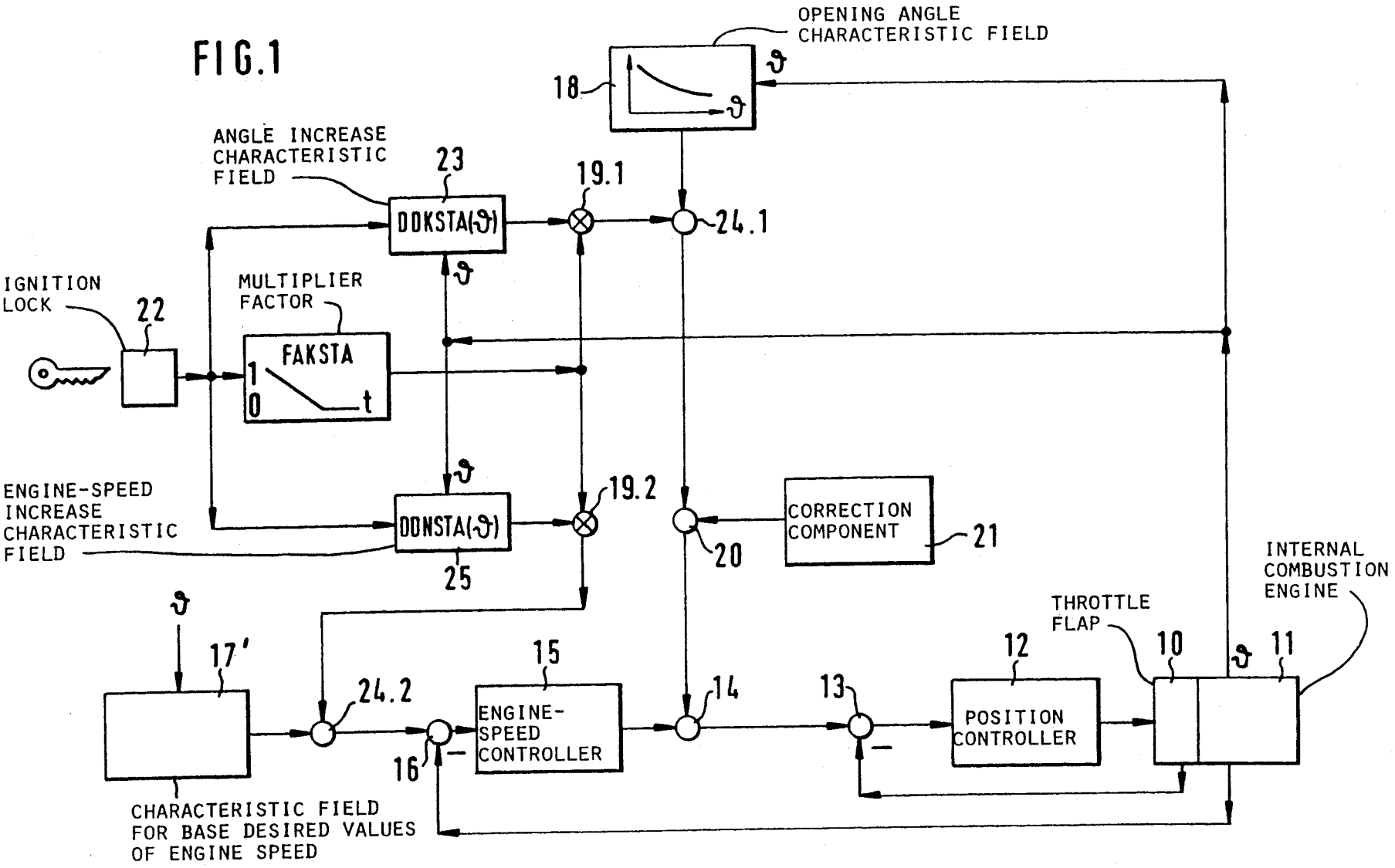
FIG. 1 is a functional block diagram for explaining an embodiment of the method and arrangement of the invention for precontrolling the opening angle of a throttle flap during the idle engine-speed control with the aid of a temperature-dependent angle increase; and, FIG. 2 is a functional block diagram for a known method of precontrolling the opening angle of a throttle flap during the idle engine-speed control.
Figure 2:
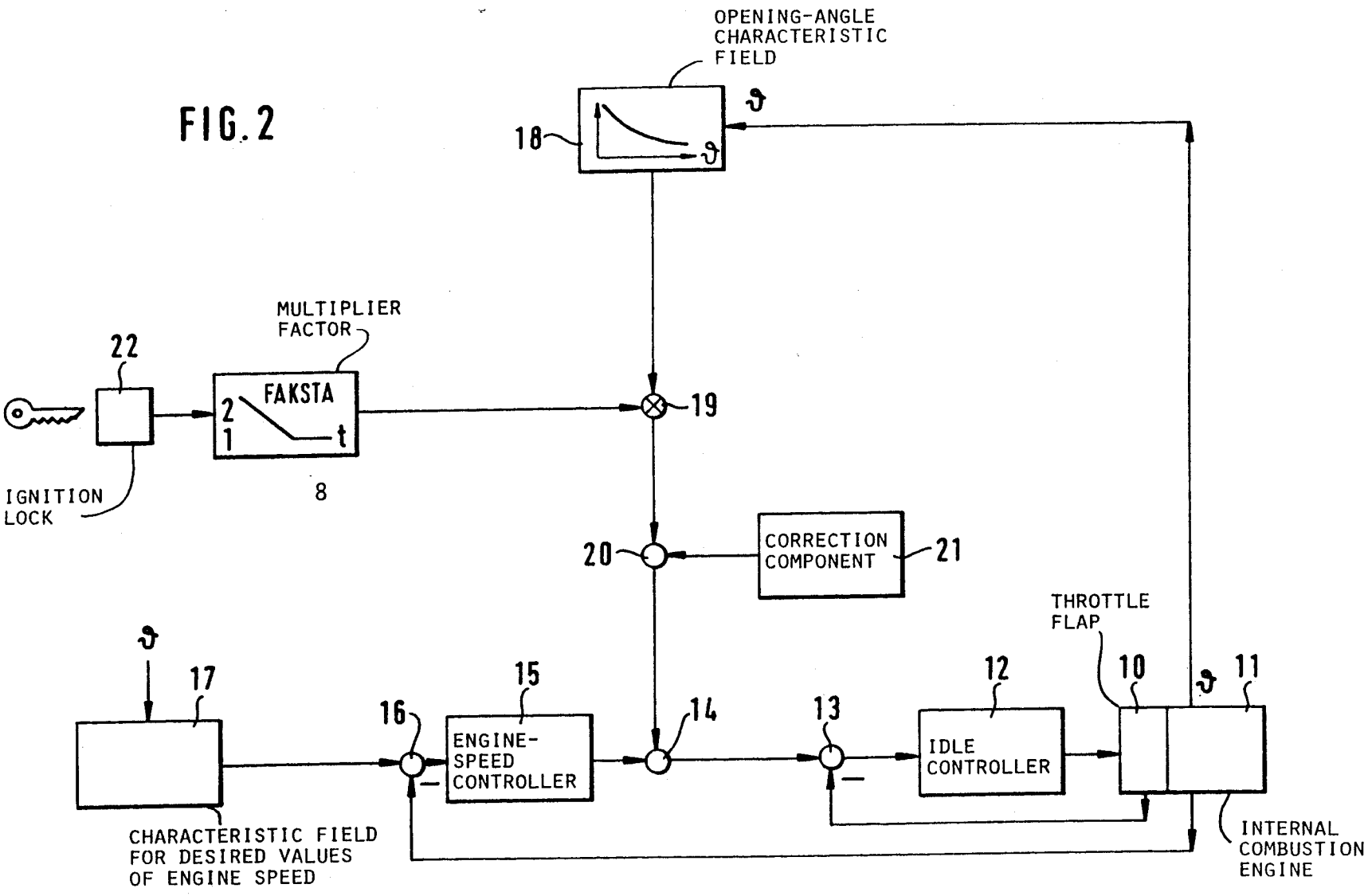

The arrangement and method for precontrolling the opening angle of a throttle flap during the idle engine-speed control of an engine, as explained in the following with respect to FIG. 1, operate basically as the known arrangement or the usual method as described in FIG. 2. However, the multiplier factor FAKSTA is not multiplied directly with the base desired value DK_GRUNDSOLL for the opening angle of the throttle flap; instead, a multiplication with a temperature-dependent angle increase DDKSTA occurs and the above-mentioned base desired value is only then modified with the product, that is by adding the product. For this sequence, and in addition to the function groups explained with respect to FIG. 2, FIG. 1 shows an angle increase characteristic field 23 from which the above-mentioned temperature-dependent angle increase DDKSTA is read out in response to a start signal from the ignition lock 22. In a first multiplier position 19.1, a multiplicative combination takes place with the factor FAKSTA and, in a first modifier position 24.1, the product is added to the base desired value DK_GRUNDSOLL.

The colder the engine 11 is at start, the greater the temperature-dependent angle increase DDKSTA will be. The angle increase is multiplied by the value one of the start factor FAKSTA at the instant of starting. However, this value decays within a few seconds to the value zero whereupon the product emitted by the first multiplier position 19.1 becomes zero and accordingly, the base desired value DK_GRUNDSOLL is transmitted unchanged. For warmer engines, such an unchanged transmission takes place already at the instant of start since, in this case, the temperature-dependent angle increase DDKSTA has a value near zero already at start or has the value zero. No correction value then results even when there is a multiplication by the value one of the factor FAKSTA. It is noted that independently as to whether the correction just discussed is present or not, in the start case, the correction of the base desired value DK_GRUNDSOLL can take place with correction variables as they are emitted by the correction component 21 in the combining position 20 as before.

In addition to the additional function groups already mentioned above, the function block circuit diagram of FIG. 1 also has the following additional function groups in contrast to those shown in FIG. 2: an engine-speed increase characteristic field 25, a second multiplier position 19.2 and a second modifier position 24.2. The characteristic field 17 for temperature-dependent engine-speed desired values is replaced by a characteristic field 17' for temperature-dependent base desired values N_GRUNDSOLL of the engine speed.

The function groups just mentioned operate on the engine speed in a manner corresponding to the additional function groups mentioned above for modifying the precontrol of the throttle flap angle. In the start case, a temperature-dependent engine-speed increase value is read out from the characteristic field 25 for the engine-speed increases. This engine-speed increase value is multiplied by the factor FAKSTA in the second multiplier position 19.2 whereupon the product is added in the second modifier position 24.2 to a temperature-dependent base desired value N_GRUNDSOLL for the engine speed. Correspondingly, as described above for the opening angle of the throttle flap, an engine-speed increase in the start phase can be easily realized in the start case of a cold engine without this leading to an engine-speed increase in the start phase for warm engines.

The described method sequences provide the further advantages that the characteristic fields for base desired values can be applied while considering only the performance of a warm engine. The performance of a cold engine is considered with the aid of the factor FAKSTA and the temperature-dependent angle increase and, if required, also the temperature-dependent engine-speed increase.

In the embodiment described, a temperature-dependent angle increase as well as a temperature-dependent engine-speed increase are undertaken. This affords advantages because of the simple manner in which this is realized. Considerable advantages compared to known methods are already provided when the described modification of the precontrol angle of the opening angle of the throttle flap is undertaken by itself.

It is understood that the foregoing description is that of the preferred embodiments of the invention and that various changes and modifications may be made thereto without departing from the spirit and scope of the invention as defined in the appended claims.

What is claimed is:

1. A method for precontrolling the opening angle of a throttle flap of an internal combustion engine during the idle engine-speed control thereof with the aid of a function block providing a time-reduced multiplier factor, the method comprising the steps of:

determining a temperature-dependent base desired value for said opening angle;

determining a temperature-dependent angle increase at the start of the engine;

multiplying said angle increase by said time-reduced multiplier factor to form a product; and, adding said product to said base desired value within a start-time duration of the engine.

2. The method of claim 1, further comprising the steps of:

determining a temperature-dependent engine-speed increase at the start of the engine;

multiplying said engine-speed increase by said multiplier factor to form a second product; and, adding said second product to an engine-speed base desired value.

3. The method of claim 1, wherein said multiplier factor changes from one to zero during the time-dependent reduction thereof.

4. An arrangement for precontrolling the opening angle of a throttle flap during the idle engine-speed control of an internal combustion engine, the arrangement comprising:

first means for determining a temperature-dependent base desired value for the opening angle;

second means for emitting a time-reduced multiplier factor for modifying said base desired value;

third means for determining a temperature-dependent angle increase at the start of the engine;

multiplier means for multiplying said angle increase by said time-reduced multiplier factor to form a product; and, adding means for adding said product to said base desired value.

5. The arrangement of claim 4, further comprising:

fourth means for emitting an engine-speed base desired value;

fifth means for determining a temperature-dependent engine-speed increase at the start of the engine;

second multiplier means for multiplying said engine-speed increase by said time-reduced multiplier factor to form a second product; and, second adding means for adding said second product to said engine-speed base desired value.

* * * * *